US007481613B2

(12) United States Patent
Hong et al.

(10) Patent No.: US 7,481,613 B2
(45) Date of Patent: Jan. 27, 2009

(54) WATER PUMP

(75) Inventors: Alex Hong, Kaohsiung (TW); Wei Chen Chen, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 252 days.

(21) Appl. No.: 11/213,723

(22) Filed: Aug. 30, 2005

(65) Prior Publication Data

US 2006/0045734 A1 Mar. 2, 2006

(30) Foreign Application Priority Data

Aug. 30, 2004 (TW) ..... 93126056 A

(51) Int. Cl.
*F01D 25/16* (2006.01)

(52) U.S. Cl. ..... 415/112; 415/900; 416/174

(58) Field of Classification Search ..... 415/112, 415/900; 416/174; 417/420
See application file for complete search history.

(56) References Cited

U.S. PATENT DOCUMENTS 5,393,207 A * 2/1995 Maher et al. ..... 417/423.7
5,575,630 A * 11/1996 Nakazawa et al. ..... 417/420
6,135,710 A * 10/2000 Araki et al. ..... 415/206
6,439,845 B1 * 8/2002 Veres ..... 415/206
6,689,310 B1 * 2/2004 Cooper ..... 266/235
7,008,196 B2 * 3/2006 Hokkirigawa et al. .... 417/423.3

* cited by examiner

*Primary Examiner*—Edward Look
*Assistant Examiner*—Aaron R Eastman
(74) *Attorney, Agent, or Firm*—Bacon & Thomas, PLLC

(57) ABSTRACT

The water pump comprises: a body, a rotating device, a driving device, an upper cover and a bottom cover. A lower contacting element is mounted below a bearing, and is capable of contacting a bottom end of a shaft. The upper cover has an upper contacting element being capable of contacting a top end of the shaft. When the rotating device rotates, the top end of the shaft touches the upper contacting element in one-point way to avoid the problem of rubbing the blades of the rotating device and the upper cover. Besides, the shaft, the bearing, the upper contacting element and the lower contacting element are made of a waterproof and rustproof material with well wear character to absorb the water or the cooling liquid which can be a lubrication to reduce the wear to extend the life of the above elements.

18 Claims, 5 Drawing Sheets

WATER PUMP

BACKGROUND OF THE INVENTION

1. Field of the Invention

The present invention relates to a water pump. The water pump is mounted on a circulating loop of a cooling water type heat dissipating system so as to drive liquid to flow on the circulating loop to dissipate heat.

2. Description of Related Art

The conventional cooling water type heat dissipating system has two categories. The first conventional cooling water type heat dissipating system is disclosed in Taiwan Utility Model Publication No. 584266. The first conventional cooling water type heat dissipating system comprises a body, a motor and a fan blade. The body has an upper cover, a separating layer and a lower cover, and is formed an enclosed space filled with liquid. The motor and the fan blade are mounted on the enclosed space. The body further comprises an inlet pipe and an outlet pipe which are connected to a loop. When the motor drives the fan blade to rotate, the liquid is driven by the fan blade to flow in the loop so as to dissipate heat.

Taiwan Utility Model Publication No. 587784 discloses the second conventional cooling water type heat dissipating system. The second conventional cooling water type heat dissipating system comprises a shell, a coil assembly and a fan assembly. The shell has an upper cover and a bottom set, and is formed an enclosed space filled with liquid. The fan assembly is mounted on the enclosed space. The shell further comprises an input portion and an output portion which are connected to a loop. The coil assembly is mounted outside of the bottom set. When the coil assembly drives the fan assembly to rotate, the liquid is driven from the input portion to the output portion so as to dissipate heat.

However, in the two patent, there are defects of losing original precision and rotational balance, and they are caused by rubbing the fan blade (or fan) and the upper cover, and then the fan blade (or fan) is worn.

Referring to FIG. 5, it shows the second conventional cooling water type heat dissipating system. The fan 60 has a plurality of fan blades 61 for driving water to flow. Therefore, the velocity of liquid around the fan blades 61 is high, and the velocity of liquid under the fan blades 61 is low owing to the eddy section 63 formed by the eddy effect. The difference of the velocity can cause the pressure difference. That is, when the velocity is high, the pressure is low; and when the velocity is low, the pressure is high. Therefore, the higher pressure under the fan 60 will push the fan 60 upwardly to cause the following two problems, during the period of the rotation:

1. Because the fan 60 is moved upwardly, the fan blades 61 continuously rub the upper cover 62. As a result, the fan blades 61 and the upper cover 62 are worn.

2. If a bottom portion of the shaft of the fan 60 is fixed by a fixed element, the fixed element rub the bearing when the fan 60 is moved upwardly. Accordingly, the bearing is worn.

Besides, the density of the liquid is higher than that of the air, so the pressure difference caused by rotation in the liquid is higher than that in the air. Therefore, in the cooling water type heat dissipating system, the wear of the upper cover and the bearing is faster than that in the air cooling type heat dissipating system. Therefore, it is needed to solve the above problems.

SUMMARY OF THE INVENTION

An object of the present invention is to provide a water pump. The water pump comprises: a body, a rotating device, a driving device, an upper cover and a bottom cover. The body has a separating board for defining an upper space and a lower space in the body. A bearing is mounted on the separating board. The rotating device is mounted in the upper space, and has a shaft on the middle portion of the rotating device. The shaft penetrates through the bearing for rotation. A lower contacting element is mounted below the bearing, and is capable of contacting a bottom end of the shaft. The driving device is mounted in the lower space. The upper cover is fixed on the body, and has an inlet pipe, an outlet pipe and an upper contacting element. The upper contacting element is capable of contacting a top end of the shaft. The bottom cover is fixed under the body.

When the rotating device rotates, the rotating device moves upwardly owing to the pressure difference. The top end of the shaft touches the upper contacting element in one-point way to avoid the problem of rubbing the spiral blades of the rotating device and the upper cover. Besides, the shaft, the bearing, the upper contacting element and the lower contacting element are made of a waterproof and rustproof material with well wear character, for example ceramic material or graphite material. The ceramic material and graphite material have multi-micro holes character, so can absorb the water or the cooling liquid. Therefore, during the rotation of the rotating device, the water or cooling liquid can be a lubrication to reduce the wear between the top (or bottom) end of the shaft and the upper (or lower) contacting element so as to extend the life of the shaft, the bearing, the upper contacting element and the lower contacting element.

DETAILED DESCRIPTION OF THE PREFERRED EMBODIMENTS

Figure 1:
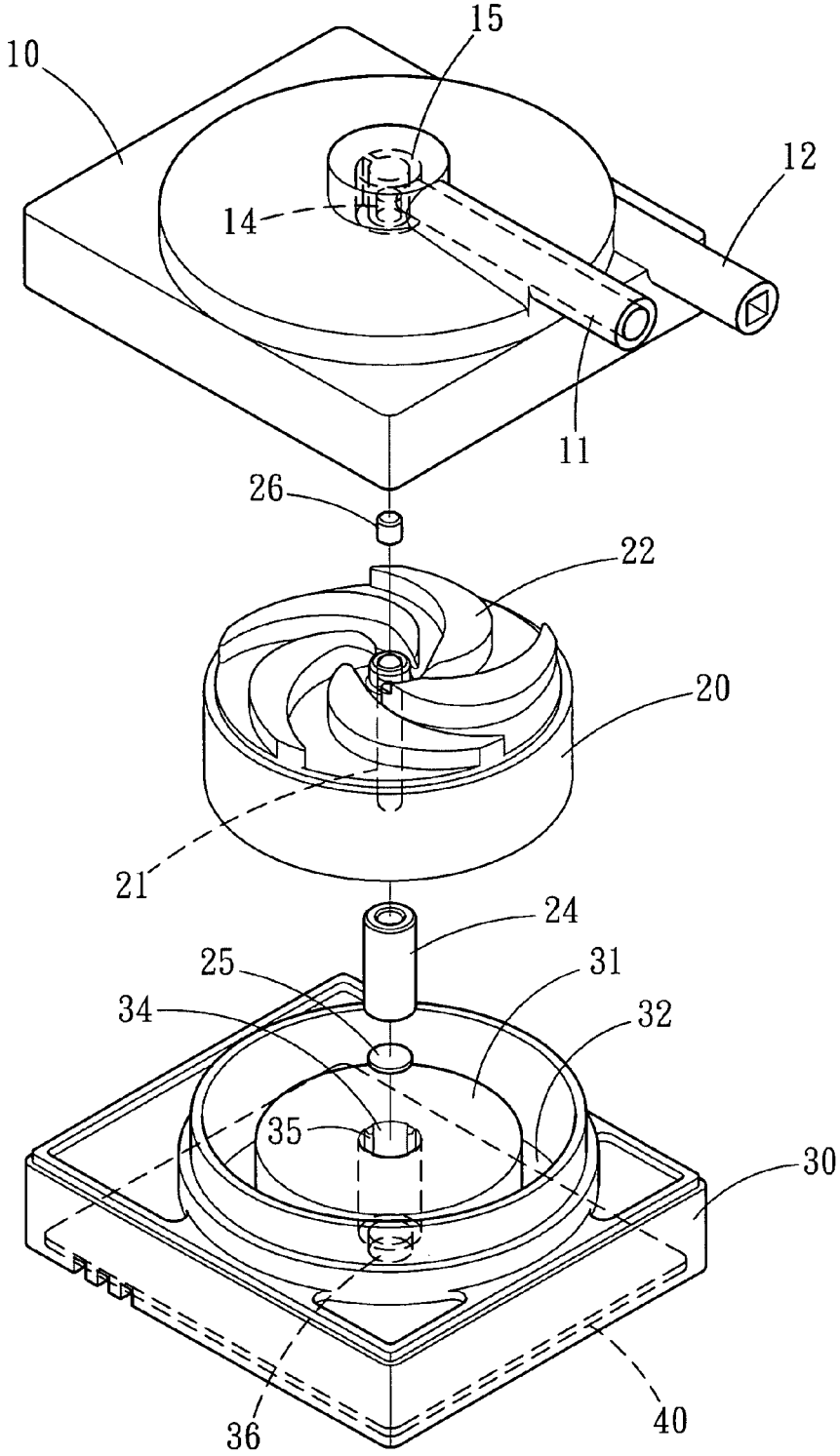
FIG. 1 is an exploded perspective view of a water pump according to the invention.
Figure 3:
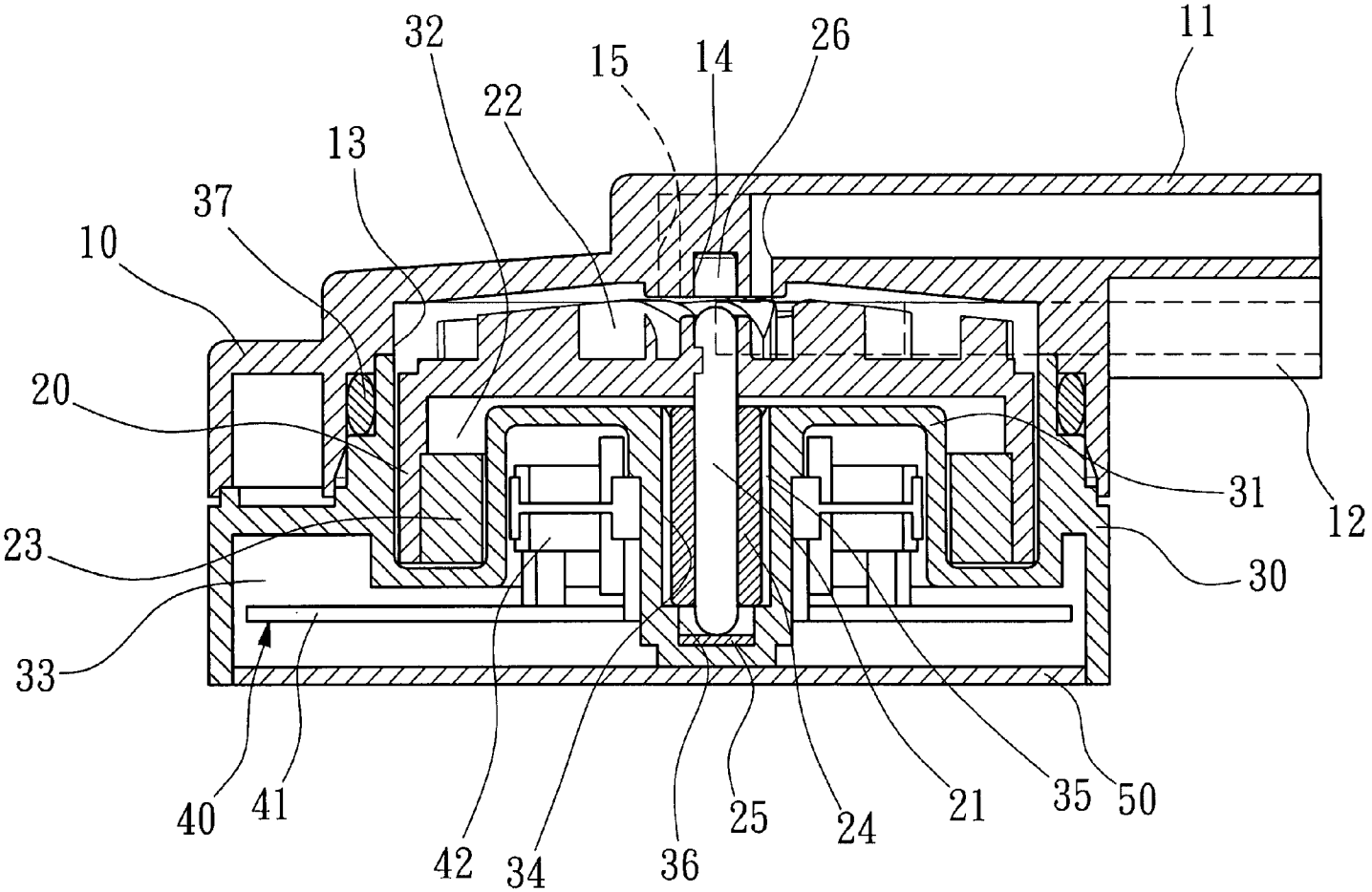
FIG. 3 is a sectional view of the water pump according to the invention.

Referring to FIG. 1 and FIG. 3, according to the present invention, they show a water pump. The water pump comprises: an upper cover 10, a rotating device 20, a body 30, a driving device 40 and a bottom cover 50. The upper cover 10 comprises an inner room 13 with a downward open. The inner room 13 has a containing recess 14 on the middle portion inside of the inner room 13. An annular path 15 is mounted on the peripheral side of the containing recess 14, The upper cover 10 has an inlet pipe 11, an outlet pipe 12 and an upper contacting element 26. The annular path 15 is connected to the inlet pipe 11, and the outlet pipe 12 is connected to the inner room 13. The inlet pipe 11 and the outlet pipe 12 are connected to a pipe loop for cooling liquid or cooling water.

The rotating device 20 is formed as an inverted-U shape, and comprises a plurality of spiral blades 22 and a permanent magnet 23. The spiral blades 22 are mounted on the top surface of the rotating device 20, and the permanent magnet 23 is mounted on the inner wall of the rotating device 20. The rotating device 20 has a shaft 21 on the middle portion of the rotating device 20. The top end and the bottom end of the shaft 21 are formed as a ball shape.

The body 30 has a separating board 31 for defining an upper space 32 and a lower space 33 in the body 30. The shape of the upper space 32 is corresponding to the shape of the inner room 13 of the upper cover 10. The separating board 31 has a shaft tube 34, and the shaft tube 34 has a slot 36 on the bottom of the shaft tube 34. A plurality of axial ribs 35 are mounted on the inner wall of the shaft tube 34.

The driving device 40 comprises a circuit board 41 and a stator assembly 42. The bottom cover 50 is formed as a corresponding shape with the lower space 33 of the body 30.

Figure 2:
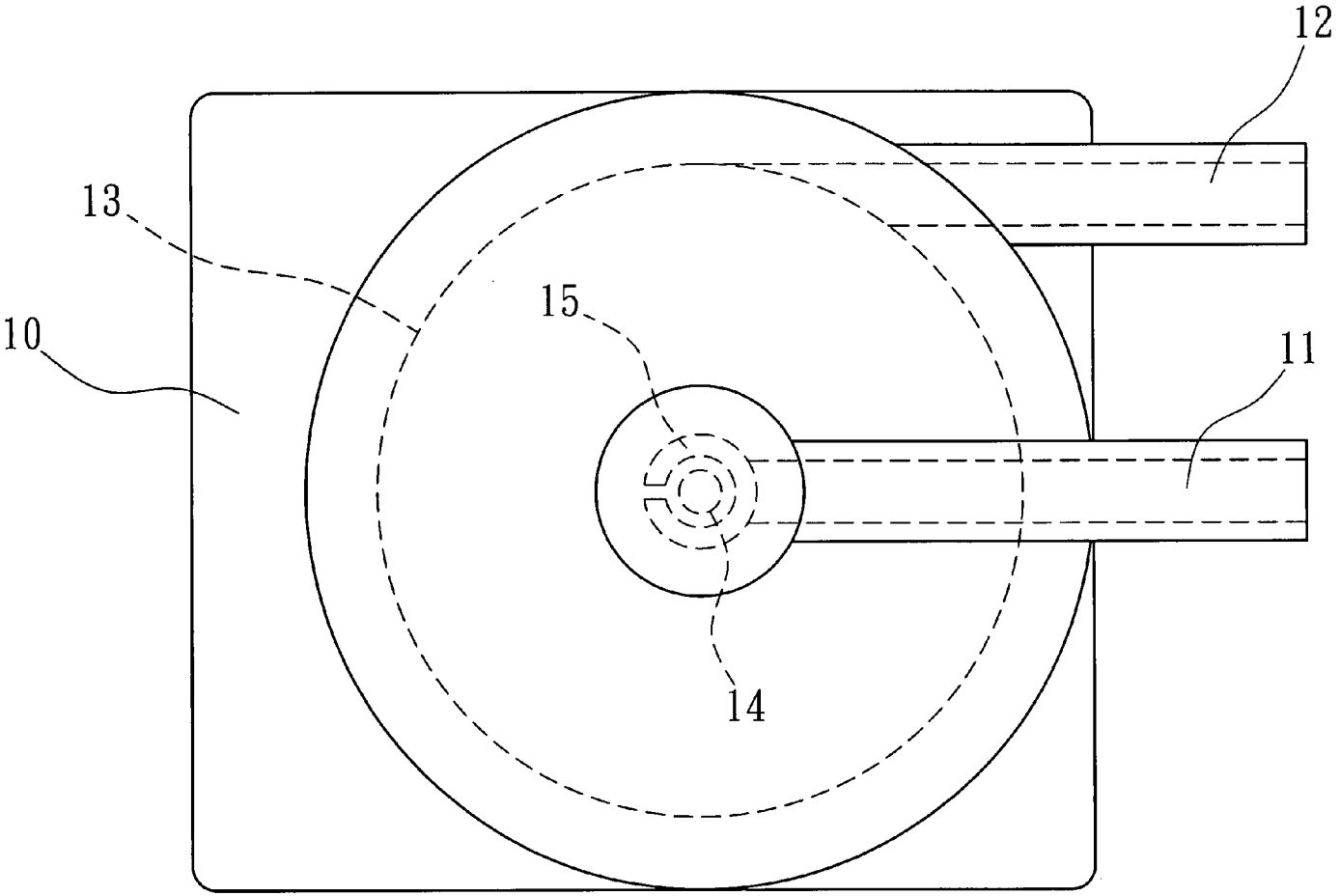
FIG. 2 is a top view of the water pump according to the invention.

Referring to FIG. 2 and FIG. 3, the driving device 40 is mounted in the lower space 33 under the separating board 31 of the body 30. The bottom cover 50 is fixed under the body 30. A lower contacting element 25 is disposed in the slot 36 of the body 30, and a bearing 24 is disposed in the shaft tube 34 so that the shaft 21 of the rotating device 20 penetrates through the bearing 24 for rotation. That is, the lower contacting element 25 is mounted below the bearing 24, and is capable of contacting the bottom end of the shaft 21. The rotating device 20 is disposed in the upper space 32 of the body 30. The separating board 31 spaces apart the permanent magnet 23 and the stator assembly 42. The upper contacting element 26 is disposed in the containing recess 14 of the upper cover 10. The upper contacting element 26 is capable of contacting the top end of the shaft 21. The upper cover 10 is fixed on the body 30 by sealing an O-ring 37 and glue.

The inner room 13 is filled with water or cooling liquid. When the rotating device 20 is static, the bearing 24 can support the shaft 21, and the bottom end of the shaft 21 touches the lower contacting element 25 in one-point way because the bottom end of the shaft 21 is formed as a ball shape.

Figure 4:
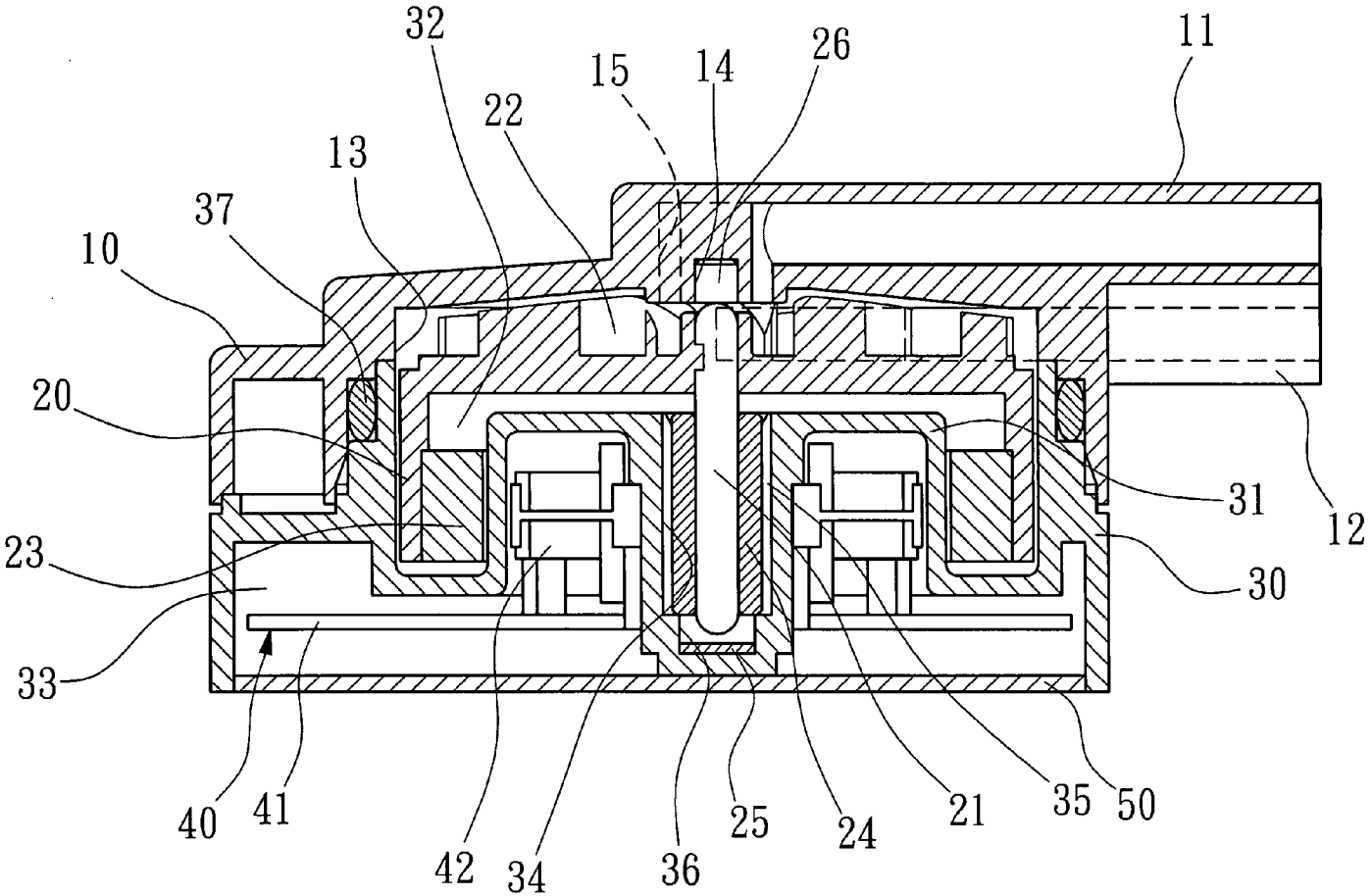
FIG. 4 is a sectional view of the water pump in the rotation according to the invention.
Figure 5:
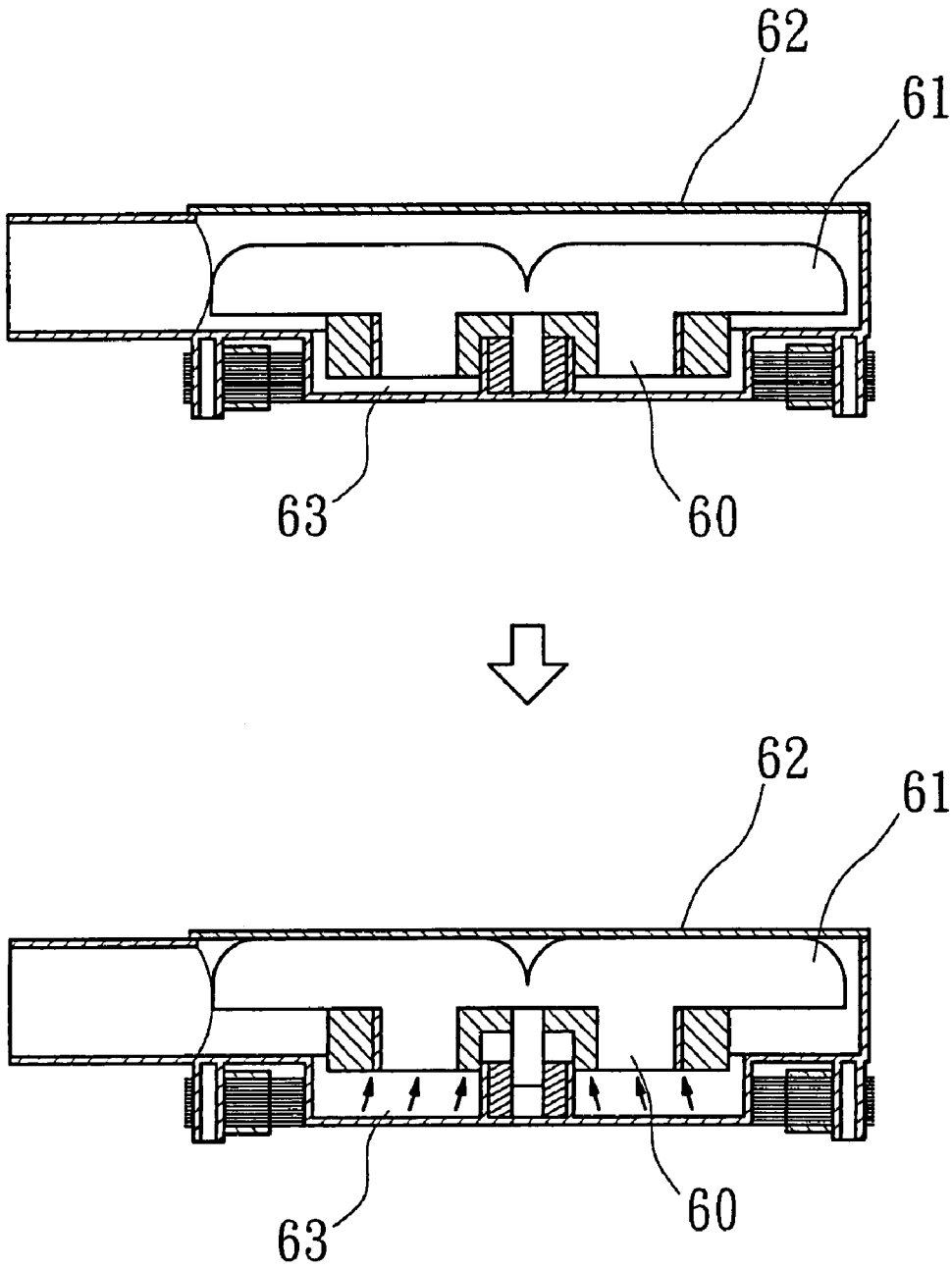
FIG. 5 PRIOR ART
FIG. 5 is a sectional view showing the second conventional cooling water type heat dissipating system.

Referring to FIG. 4, when the rotating device 20 rotates, the fan blades 22 drives the water or cooling liquid to flow. The water or cooling liquid enters from the inlet pipe 1, and drain from the outlet pipe 12. At this time, because of the pressure difference, the rotating device 20 moves upwardly, and the bearing 24 can still support the shaft 21. However, the top end of the shaft 21 touches the upper contacting element 26 in one-point way because the top end of the shaft 21 is formed as a ball shape. Therefore, the problem of rubbing the spiral blades 22 of the rotating device 20 and the upper cover 10 can be avoided. Besides, the problem of rubbing the fixed element and the bearing 24 can also be avoided. In the embodiment, the gap between the top (or bottom) end of the shaft 21 and the upper (or lower) contacting element can't exceed 0.5 mm.

Furthermore, the shaft 21, the bearing 24, the upper contacting element 26 and the lower contacting element 25 are made of a waterproof and rustproof material with well wear character, for example ceramic material or graphite material. The ceramic material and graphite material have multi-micro holes character, so can absorb the water or the cooling liquid. Therefore, during the rotation of the rotating device 20, the water or cooling liquid can be a lubrication to reduce the wear between the top (or bottom) end of the shaft 21 and the upper (or lower) contacting element so as to extend the life of the shaft 21, the bearing 24, the upper contacting element 25 and the lower contacting element 26.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A water pump comprising:

a body, having a separating board for defining an upper space and a lower space in the body, a bearing mounted on the separating board;

a rotating device, mounted in the upper space and having a shaft on the middle portion of the rotating device, the shaft penetrating through the bearing for rotation, a lower contacting element mounted below the bearing and being capable of contacting a bottom end of the shaft;

a driving device, mounted in the lower space;

an O-ring;

an upper cover, fixed on the body by the O-ring and glue, having an inlet pipe, an outlet pipe, and an upper contacting element, the upper contacting element being in contact with a top end of the shaft; and a bottom cover, fixed under the body;

wherein the upper contacting element and the lower contacting element are made of a waterproof and rustproof; and wherein the separating board has a shaft tube, the shaft tube has a slot on the bottom of the shaft tube, the bearing is disposed in the shaft tube, the lower contacting element is disposed in the slot, and the shaft passes through the shaft tube.

2. The water pump as claimed in claim 1, wherein the upper cover has a containing recess mounted on the position corresponding to the top end of the shaft, the upper contacting element is disposed in the containing recess.

3. The water pump as claimed in claim 2, wherein the upper cover has an annular path mounted on the peripheral side of the containing recess, and the annular path is connected to the inlet pipe.

4. The water pump as claimed in claim 1, further comprising a plurality of axial ribs mounted on the inner wall of the shaft tube.

5. The water pump as claimed in claim 1, wherein the shaft is made of a waterproof and rustproof.

6. The water pump as claimed in claim 5, wherein the shaft is made of ceramic material.

7. The water pump as claimed in claim 5, wherein the shaft is made of graphite material.

8. The water pump as claimed in claim 1, wherein the bearing is made of a waterproof and rustproof material.

9. The water pump as claimed in claim 8, wherein the bearing is made of ceramic material.

10. The water pump as claimed in claim 8, wherein the bearing is made of graphite material.

11. The water pump as claimed in claim 1, wherein the upper contacting element is made of ceramic material.

12. The water pump as claimed in claim 1, wherein the upper contacting element is made of graphite material.

13. The water pump as claimed in claim 1, wherein the lower contacting element is made of ceramic material.

14. The water pump as claimed in claim 1, wherein the lower contacting element is made of graphite material.

15. The water pump as claimed in claim 1, wherein the top end of the shaft and the bottom end of the shaft are formed as ball shape.

16. The water pump as claimed in claim 1, wherein the rotating device further comprises a plurality of spiral blades and a permanent magnet, the spiral blades are mounted on the top surface of the rotating device, and the permanent magnet is mounted on the inner wall of the rotating device.

17. The water pump as claimed in claim 1, wherein the upper cover further comprises an inner room with a downward open, the inner room is filled with water, and the inlet pipe and the outlet pipe are connected to a water pipe loop.

18. The water pump as claimed in claim 1, wherein the upper cover further comprises an inner room with a downward open, the inner room is filled with cooling liquid, and the inlet pipe and the outlet pipe are connected to a cooling liquid pipe loop.

* * * * *